US005407207A

United States Patent [19]

Stanford

[11] Patent Number: 5,407,207

[45] Date of Patent: Apr. 18, 1995

[54] BOARD GAME SIMULATING FINANCIAL EVENTS OF A LIFETIME

[76] Inventor: Carlton R. Stanford, 307 W. Highway 60, Republic, Mo. 65738

[21] Appl. No.: 151,953

[22] Filed: Nov. 15, 1993

[51] Int. Cl.[6] ..... A63F 3/00

[52] U.S. Cl. ..... 273/256

[58] Field of Search ..... 273/242, 243, 256, 278

[56] References Cited

U.S. PATENT DOCUMENTS

| | | | |
|---|---|---|---|
| 53,561 | 4/1866 | Bradley . | |
| 2,182,531 | 12/1939 | Beard . | |
| 4,150,827 | 4/1979 | Barnett | 273/256 |
| 4,279,422 | 7/1981 | Shaw | 273/256 |
| 4,416,454 | 11/1983 | DeLamontagne | 273/243 |
| 4,932,668 | 6/1990 | Stewart | 273/256 |
| 4,936,589 | 6/1990 | Sinclair | 273/256 X |
| 5,071,135 | 12/1991 | Campbell | 273/256 |
| 5,118,113 | 6/1992 | Ahlers et al. | 273/243 |
| 5,261,672 | 11/1993 | Jordan | 273/256 |

FOREIGN PATENT DOCUMENTS

| | | | |
|---|---|---|---|
| 1258689 | 8/1989 | Canada | 273/256 |
| 2163665 | 3/1986 | United Kingdom | 273/256 |

*Primary Examiner*—William E. Stoll

*Attorney, Agent, or Firm*—Rhodes & Ascolillo; David L. Baker

[57] ABSTRACT

A game simulating financial events that a person encounters during the person's lifetime, including: a game board having disposed thereon a path of individual financial event indicia on which indicia playing pieces may land while traversing the path, the financial event indicia indicating, in some cases, mandatory or discretional financial transactions; one of the indicia being a starting point at which each player begins the game at a first predetermined age, with age advancing one year each time the starting point is passed, up to a second predetermined age at which the game terminates; first cards, each of which indicates thereon a job and a salary therefor, each player to draw one of the first cards when the game commences; second cards, each of which indicates thereon a type of business, the purchase price thereof, and the annual profits therefrom, one of the second cards to be drawn by a player, at the discretion thereof, when having a playing piece land on one of the indicia indicating a discretionary financial transaction to be made; and random number generating mechanism to be alternatingly activated by the players to determine a number of the financial event indicia to be traversed by each the playing piece for each move thereof.

2 Claims, 6 Drawing Sheets

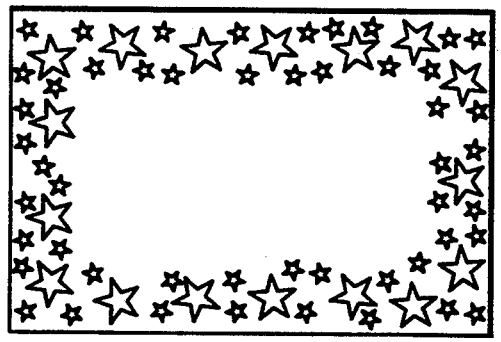
FIG. 10
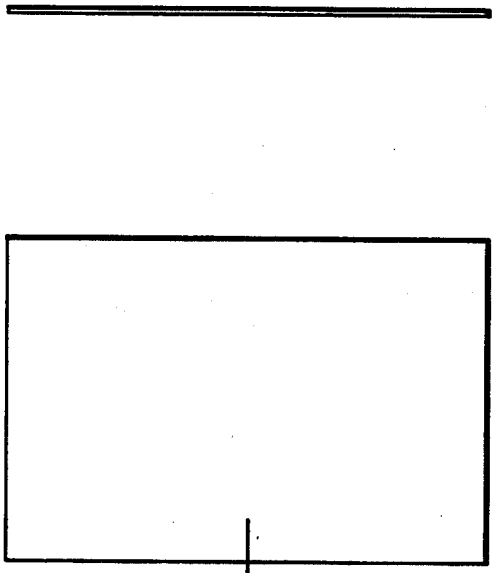
FIG. 11
FIG. 9
B-SERIES STOCK CARD
C-SERIES STOCK CARD
G-SERIES STOCK CARD
R-SERIES STOCK CARD
SAVINGS CERTIFICATE CARD
BONDS CARD
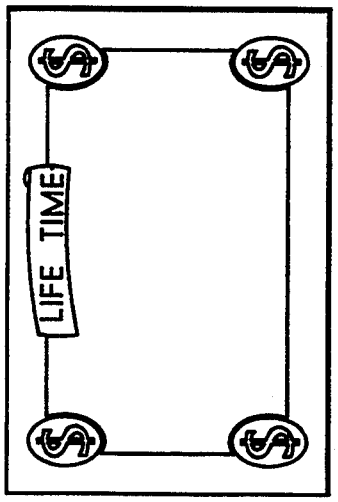
FIG. 4
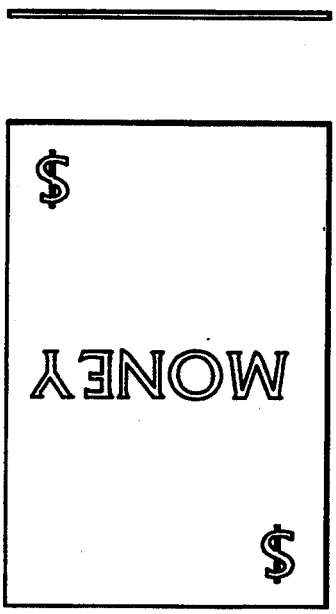
FIG. 5
FIG. 3

BOARD GAME SIMULATING FINANCIAL EVENTS OF A LIFETIME

BACKGROUND OF THE INVENTION

1. Field of the Invention

The present invention relates to games generally and, more particularly, but not by way of limitation, to a novel board game which simulates the financial events that one may encounter as one proceeds through life.

2. Background Art

The playing of board games has been a popular form of education and entertainment for many years. For example:

U.S. Pat. No. 53,561, issued Apr. 3, 1866, to Bradley, describes a board game called the "checkered game of life" and is intended, in part, to "forcibly impress upon the minds of youth the great moral principles of virtue and vice."

U.S. Pat. No. 2,026,082, issued Dec. 31, 1935, to Darrow, describes the popular game of "Monopoly" which is a game of bartering, thus involving trading and bargaining.

U.S. Pat. No. 2,182,531, issued Dec. 5, 1939, to Beard, describes a board game in which players encounter various financial transactions, the purpose of the game being for the players to achieve certain pension goals.

U.S. Pat. No. 4,279,422, issued Jul. 21, 1981, to Shaw, describes a board game directed to simulating the various academic and financial occurrences which befall a college student.

U.S. Pat. No. 4,416,454, issued Nov. 22, 1983, to Delamontagne, describes a board game which simulates a retail store environment and which is intended as a management training tool.

U.S. Pat. No. 5,118,113, issued Jun. 2, 1992, to Ahlers et al., describes a board game which is intended to heighten environmental awareness and teach measures to improve the environment.

None of the above patents describes a board game which simulates the financial events that one may encounter as one proceeds through life, as is described and claimed herein.

Accordingly, it is a principal object of the present invention to provide a board game which simulates the financial event that one may encounter as one proceeds through life.

It is a further object of the invention to provide such a board game which requires judgment as well as luck.

It is an additional object of the invention to provide such a board game in which the winner is the player who accumulates the largest net worth in a simulated lifetime.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a game simulating financial events that a person encounters during said person's lifetime, comprising: a game board having disposed thereon a path to be serially traversed by playing pieces of at least two players, said path comprising individual financial event indicia on which said playing pieces may land while traversing said path, said financial event indicia indicating, in some cases, a mandatory financial transaction for one of said at least two players whose said playing piece lands thereon and, in other cases, indicating a discretionary financial transaction to be made by one of said at least two players whose said playing piece lands thereon; one of said indicia being a starting point at which each said at least two players begins the game at a first predetermined age, said age advancing one year each time said starting point is subsequently passed, up to a second predetermined age at which said game terminates; a plurality of first cards each of which indicates thereon a job and a salary therefor, each of said at least two players to draw one of said plurality of first cards when said game commences; a plurality of second cards each of which indicates thereon a type of business, the purchase price thereof, and the annual profits therefrom, one of said plurality of second cards to be drawn by one of said at least two players, at the discretion thereof, when having a playing piece land on one of said indicia indicating a discretionary financial transaction to be made; and random number generating means to be alternatingly activated by each said at least two players to determine a number of said financial event indicia to be traversed by each said playing piece for each move thereof.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which:

FIGS. 3–5 are rear, front, and side views, respectively, of simulated money for use in playing the game of the present invention.

FIGS. 9–11 are front, rear, and side views, respectively, of simulated financial instruments for use in playing the game of the present invention.

DETAILED DESCRIPTION OF THE PREFERRED EMBODIMENTS

Figure 1A:
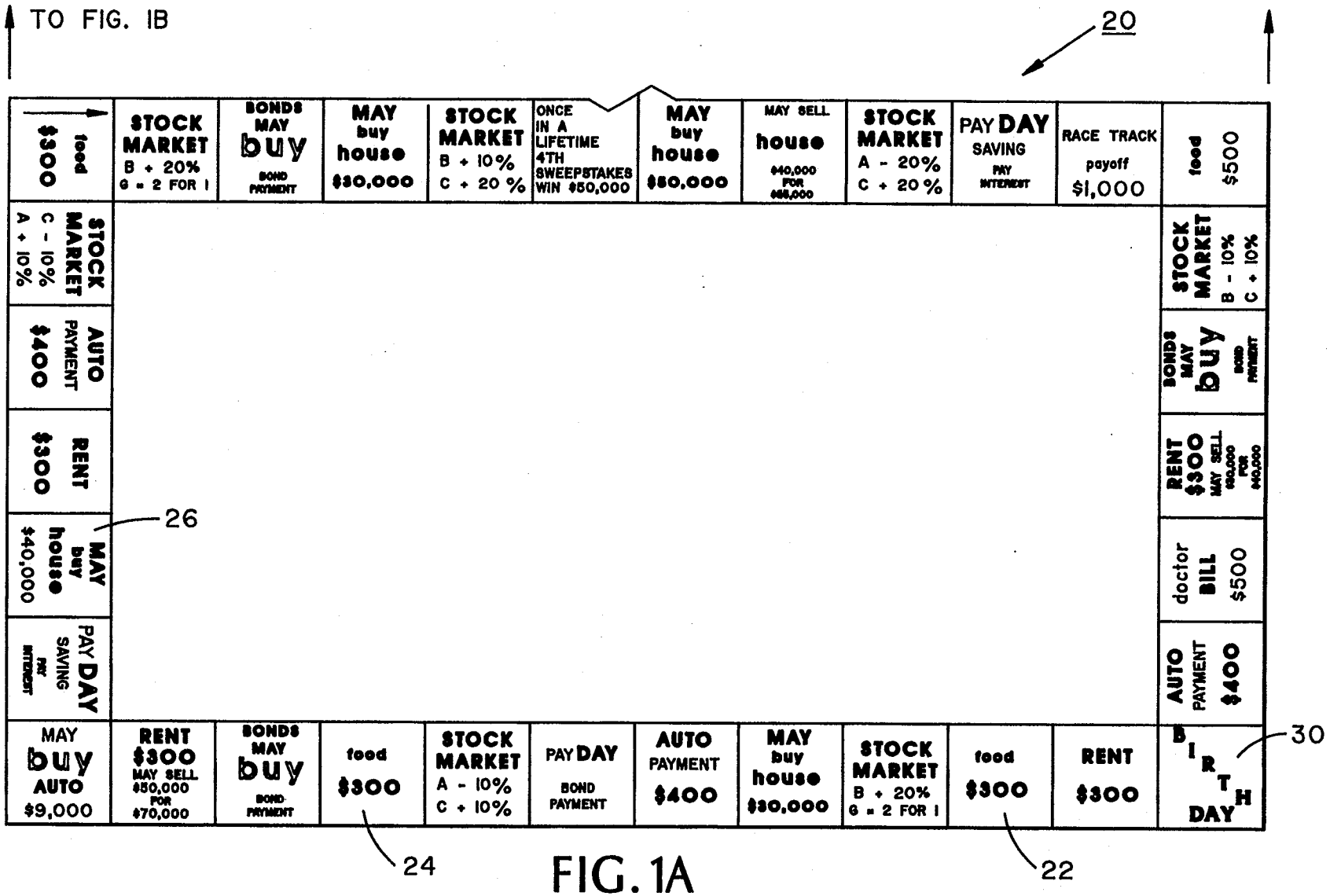
FIGS. 1(A) & (B) comprise a top plan view of the playing surface of a game board according to the present invention.
Figure 1B:
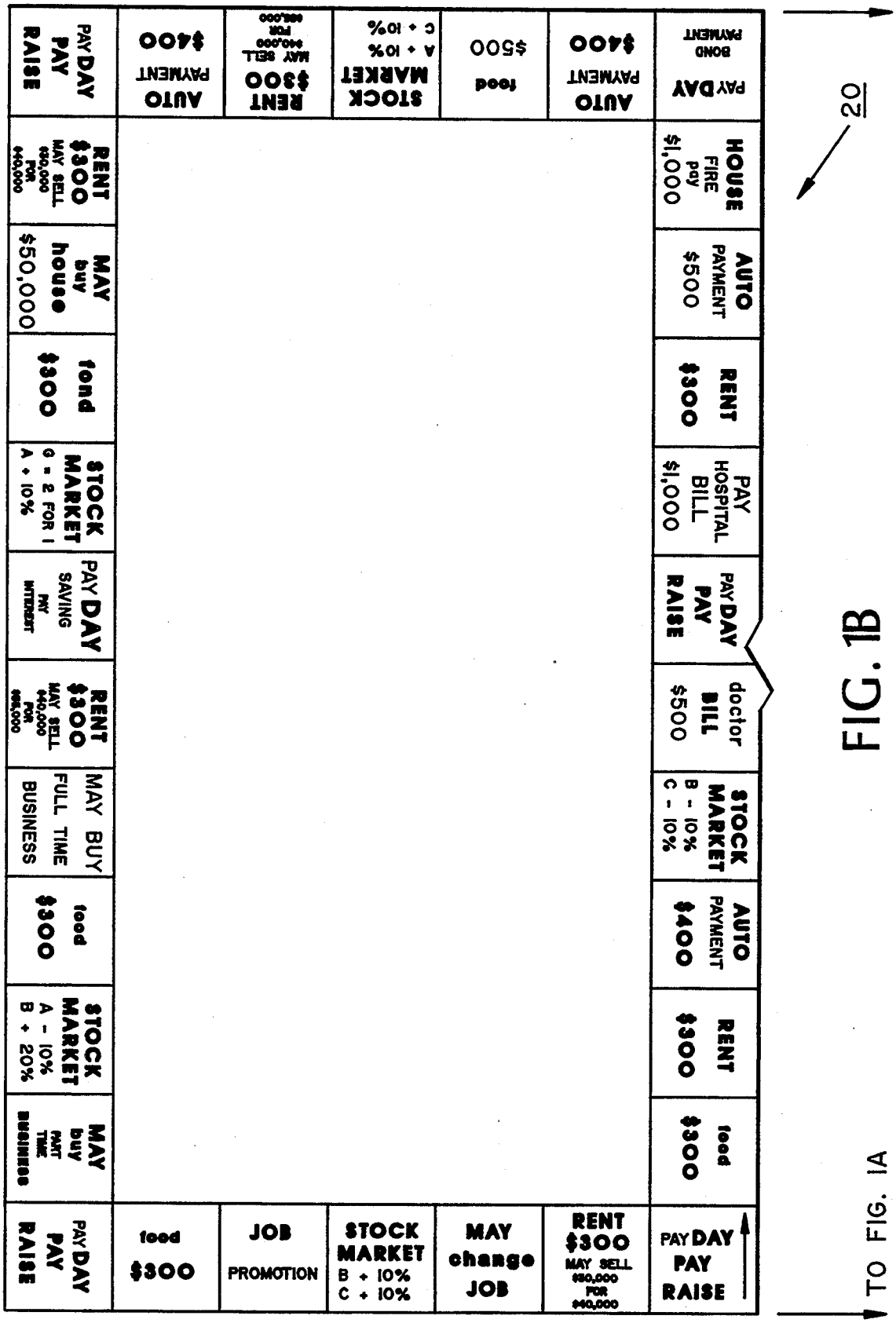
Figure 2A:
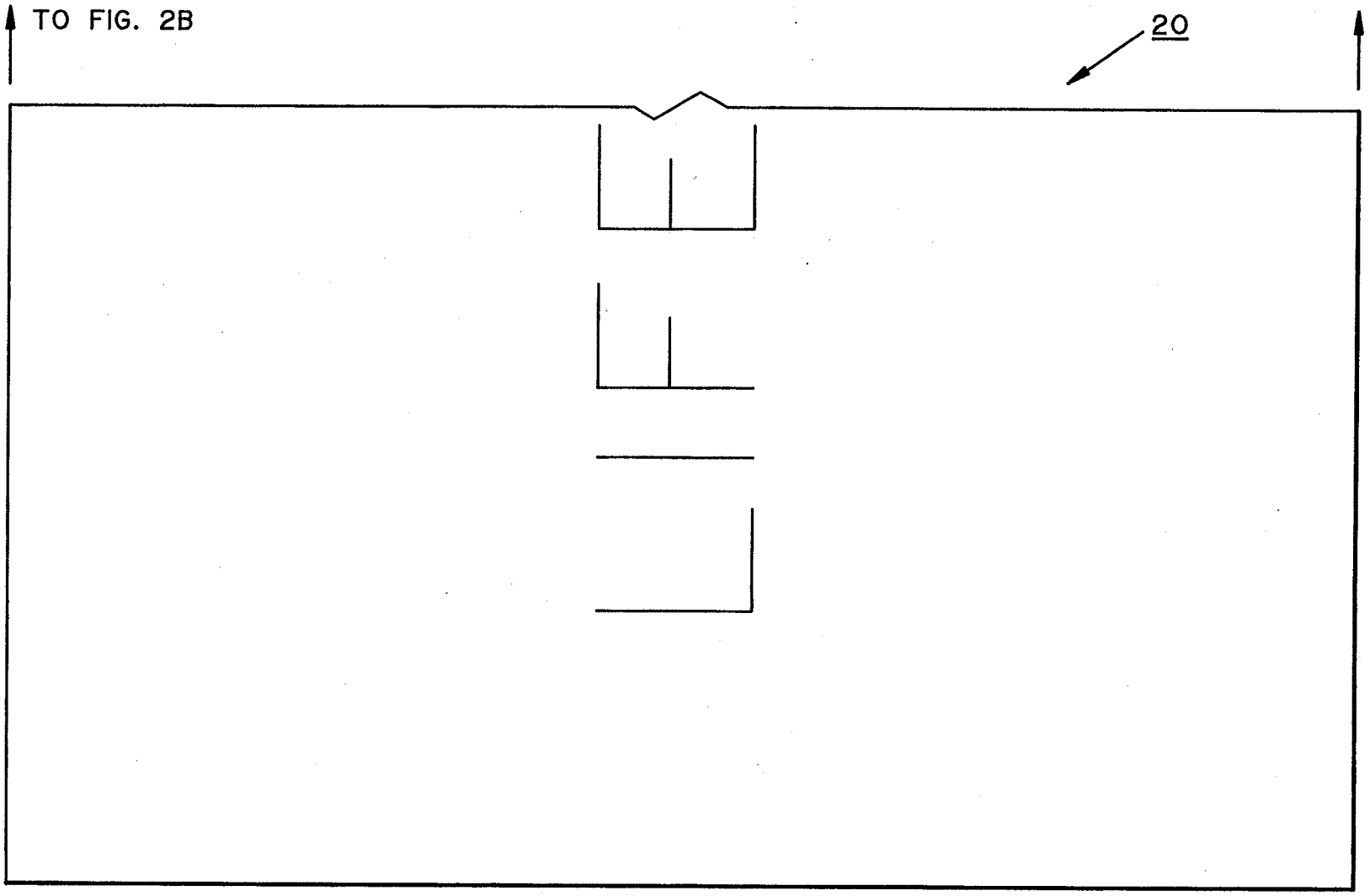
FIGS. 2(A) & (B) comprise a top plan view of the reverse surface of the game board of FIGS. 1(A) & (B).
Figure 2B:
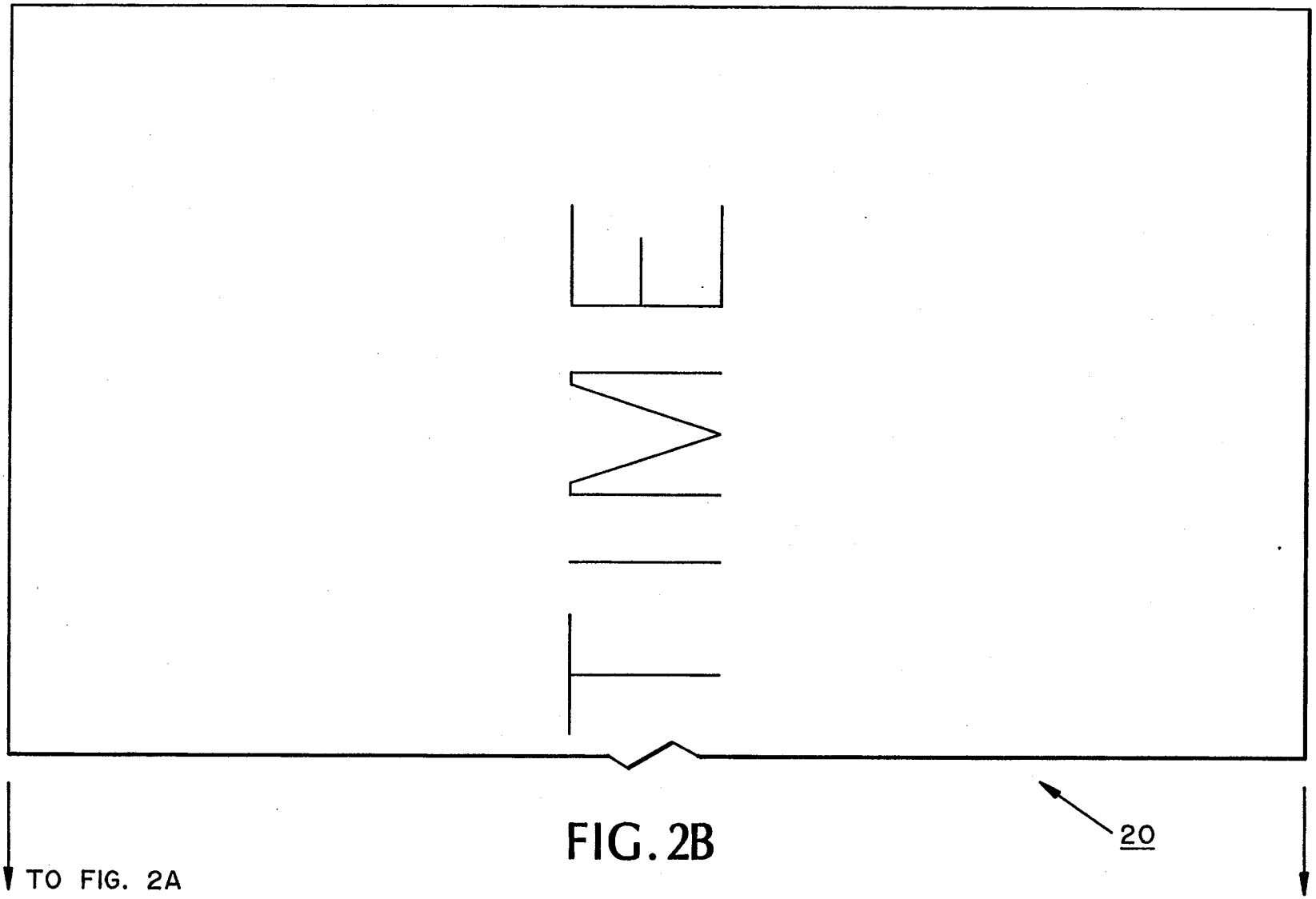

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Referring first to FIGS. 1(A) & (B), there is illustrated a game board according to the present invention, generally indicated by the reference numeral 20. Game board 20 is rectangular and includes a series of squares, as at 22, disposed about its perimeter and along two rows medially spanning the board 20. As will be understood from knowledge of other board games and as is more fully described below, each player of the game will have a playing piece (FIG. 13) which the player advances around the board 20, landing the piece on various squares 22. Each square 22 indicates thereon a financial transaction, cost, and/or opportunity that one may encounter during one's lifetime. For example, square 24 indicates that the player landing thereon must pay $300 for food and square 26 indicates that a player landing thereon may buy a home for $40,000. In short, many of the financial decisions that must be made during the course of a lifetime are included in the game. The object of the game is to become a millionaire, or even a billionaire, and the player with the greatest net worth at the conclusion of the game is deemed to be the winner thereof.

Before providing a discussion of the details of play of the game, the accessories thereto will now be described.

There are provided fourteen "Job Cards" (FIGS. 6–8), as listed below with the monthly income for each:

| | |
|---|---|
| Salesman | $1,300 |
| Doctor, M.D. | $3,200 |
| Factory Worker | $900 |
| Nurse | $2,200 |
| Car Salesman | $1,500 |
| Retail Sales, Asst. Mgr. | $1,300 |
| Retail Sales, Manager | $2,000 |
| Construction Worker | $1,500 |
| Attorney | $3,600 |
| Truck Driver | $1,500 |
| Hairstylist | $1,400 |
| Taxi Driver | $1,000 |
| Auto Repairman | $1,200 |
| Public Service Worker | $1,300 |

There are provided six each of the following part-time business cards (FIGS. 6–8), as listed below with the "cost of the business/annual profits":

| | |
|---|---|
| Laundromat | $22,000/$5,200 |
| Candy Vending Route | $11,000/$2,600 |
| Automatic Car Wash | $30,000/$7,300 |
| Snack Food Vending Route | $15,500/$4,300 |
| Car Wash | $22,000/$5,200 |
| Trailer Park | $26,000/$5,900 |

There are provided four each of the following full-time business cards (FIGS. 6–8), as listed below with the "cost of the business/annual profits":

| | |
|---|---|
| Restaurant | $75,000/$12,000 |
| Hardware Store | $160,000/$18,000 |
| Clothing Store | $120,000/$14,000 |
| New Car Dealer | $450,000/$43,000 |
| Lumber & Hardware | $350,000/$36,000 |
| Convenience Store and Gas Station | $80,000/$14,000 |
| Auto Parts Store | $95,000/$13,000 |
| Furniture Store | $280,000/$30,000 |
| Manufacturing Plant | $520,000/48,000 |
| Highway Motel | $250,000/$26,000 |
| Luxury Inn | $1,900,000/$650,000 |
| Variety Store | $135,000/$15,000 |

Figure 7:
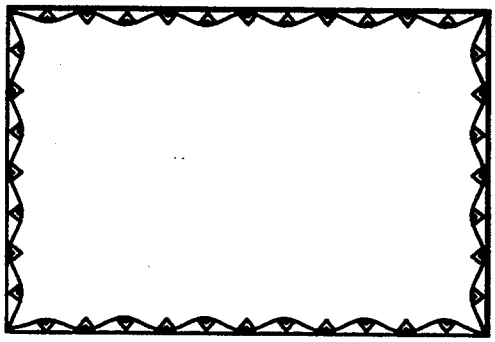
FIGS. 6–8 are front, rear, and side views, respectively, of status and financial event cards for use in playing the game of the present invention.
Figure 8:
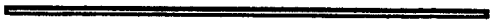
Figure 6:
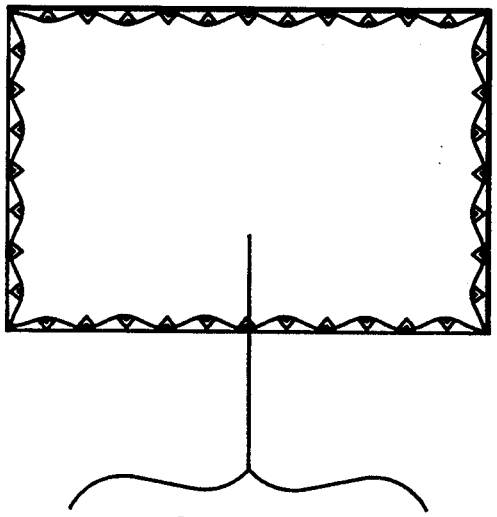

There are provided four "Auto" cards, twenty five "Pay Raise" cards, twelve "Job Promotion" cards, and twelve each of "Buy House for Rent" cards bearing the three different prices for the houses (FIGS. 6–8). These cards are employed to assist each player in keeping track of the player's status and investments.

There is provided a supply of play money (FIGS. 3–5) of various denominations.

There is provided a supply of cards simulating financial documents (FIGS. 9–11).

Figure 12:
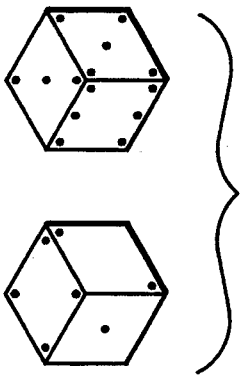
FIG. 12 illustrates dice which may be used in playing the game of the present invention.

There is provided a pair of dice (FIG. 12), although one or more dice may be employed if one wishes to lengthen or shorten, respectively, the time of play of the game.

Figure 13:
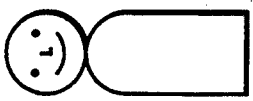
FIG. 13 illustrates a playing piece which may be used in playing the game of the present invention.

There are provided four playing pieces (FIG. 13).

To begin the game, the above groups of job and business cards (FIGS. 6–8) are placed in piles, face down, and each player draws a card from the former pile. Each player receives $2,000 from a Bank. Then, the players roll the dice (FIG. 12) and the player with the highest number moves first, then the next highest, etc. The first player starts at the "Birthday" square 30 (FIG. 1(A)), rolls the dice, moves the indicated number of squares clockwise on game board 20, and follows the instructions or makes the decisions indicated on the square on which he lands, as will be described in detail below. Each player begins the game at age 21 and advances one year in age each time the "Birthday" square is passed. Each player moves around the perimeter of game board 20 and continues to do so unless a square with an arrow on it indicates moving across the center of the board.

Each time a player passes the "Birthday" square 30 (FIG. 1(A)), that square is a payday for workers, rent, part-time and full-time businesses, and interest on bonds and savings certificates.

JOBS: Each time a player lands on a "Pay Raise" square, the player receives a pay raise of $100, and each time a player lands on a "Promotion" square, he receives a $1000 pay raise. Monthly salaries with raises are collected whenever a player passes or lands on a "Payday". If a player lands on a "May Change Job" square, he may draw another job card and change jobs, if he wishes. Any promotions and raises are retained. Pay raises and promotions are available only until the Bank runs out of money.

FOOD: If a player lands on a "Food" square, he must pay his food bill.

RENT: If a player lands on a "Rent" square, he must pay rent unless he owns a house. If a player owns a house, the player does not have to pay rent. Once a player buys a house, the player must always have at least one house and must live in one house on which rent is not collected. A player collects rent on all other houses owned each time the player passes "Birthday." Rent is ten percent of the purchase price of the house.

AUTO: If a player lands on an "Auto Payment" square, the player must make an auto payment unless the player owns an auto.

MAY BUY AUTO: If a player lands on a "May Buy Auto" square, the player may buy an auto for $9,000 cash. The auto can never be sold and, at the end of the game, it is worth nothing. A player owning an auto, however, doesn't have to make auto payments.

STOCK MARKET: When landing on this square, a player may buy all the stock the player can afford of the kind indicated on the square. If the value of the stock has increased, the player receives the amount of increase from the Bank. If the value of the stock has decreased, the player may sell the shares to the Bank at a loss or may pay the Bank the amount of the decrease. Stock may be bought only when the playing piece lands on a "Stock Market" square. If a stock split is indicated, the player receives additional shares of stock.

PAYDAY: Working people collect a paycheck every time they pass or land on "Payday". To receive interest payments, a player must land on a "Payday".

SAVING: A player may buy a saving certificate at any time on the first roll of the board between "Birthday" and "May Buy Auto," but interest is collected only when a player lands on "Payday Saving Pay Interest."

BONDS: A player may buy bonds when the player lands on "Bonds May Buy," but interest thereon may be collected only when the player passes "Birthday" or lands on "Bond Payment" or "Buy Bonds."

SELLING: A player may sell anything the player owns at any turn for what the player paid for it, except an auto, and a player must always have one house if the player has bought a house.

BORROWING MONEY: A player may borrow money from the Bank to buy a house or a part-time or full-time business, with the Bank holding the mortgage. Terms are ten percent down, ten percent interest every time "Birthday" is passed, and at least $1,000 must be paid on the principal each time interest is paid.

PART-TIME BUSINESS: A player may buy only one part-time business each time the player lands on "May Buy Part-Time Business" and profits are collected each time the player passes "Birthday."

FULL-TIME BUSINESS: A player may buy only one full-time business each time the player lands on "May Buy Full-Time Business" and profits are collected each time the player passes "Birthday." A player must give up a regular job if the player buys a full-time business. A player who is an owner of a full-time business gets paid on a birthday but not on a "Payday".

HOUSES: A player may only buy houses when the player lands on "May Buy House" and houses may be sold at any time, except for the house in which the player lives. On certain squares, houses may be sold for a profit.

ONCE IN A LIFETIME SWEEPSTAKES: A player may collect this only once in each game.

G SERIES STOCK: Each player is limited to purchasing from the Bank 1000 shares of G SERIES STOCK.

For squares not discussed above, the information thereon is self-explanatory.

After all players have reached age sixty five, the net worth of each is totalled and the player with the highest net worth is the winner of the game.

In a longer version of the game of the present invention, a player may choose to buy a chain of stores. To do so, that player must be over thirty two years old and have a net worth of over two million dollars. The manufacturing plant and the new car dealer businesses do not qualify for a chain of stores. The cost of each store is the price as listed above, plus twenty percent of that price. Annual profits from each store will be two-thirds of the amount of annual profits as listed above. The player can buy as many stores of the same type as the player wishes each time the player passes "Birthday." All purchases are for cash.

Play of the game is facilitated when each player has a note pad to keep track of financial transactions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A method of playing a financial board game comprising the steps of:

providing a game board having a path thereon to be serially traversed;

providing individual financial event indicia along the path, the indicia indicating mandatory financial transactions in certain cases and discretionary financial transactions in other cases;

providing a starting point at one of the indicia, at which a player begins the game at a first predetermined age;

providing a first set of cards, each of which indicates thereon an occupation and a corresponding salary;

distributing one of the first set of cards to each player at the beginning of the game;

providing a second set of cards, each of which indicates thereon a type of business, its corresponding purchase price and annual profits, one of the second set of cards to be drawn at the discretion of a player whenever an appropriate financial indicia permits;

providing playing pieces for each player;

providing a chance device to be alternatingly activated by each player to determine the number of indicia to be traversed by each player;

each player, upon landing their playing piece upon one of the financial event indicia, engaging in either the mandatory financial transaction or the discretionary financial transaction so indicated;

advancing the age of each player by one year upon completing the entire path; and providing an ending to the game whenever one of the players has reached a second predetermined age.

2. A method of playing a financial board game as described in claim 1, further providing a third set of cards, each of which simulates thereon a financial document, one of the third set of cards to be drawn at the discretion of a player whenever an appropriate financial indicia permits.

* * * * *